US005951051A

United States Patent [19]

Pileggi

[11] Patent Number: 5,951,051

[45] Date of Patent: Sep. 14, 1999

[54] METHOD AND APPARATUS FOR PROVIDING ACKNOWLEDGEMENT OF A RESIDENTIAL RELOCATION

[76] Inventor: Dominic J. Pileggi, 2850 Brownleaf Cove, Germantown, Tenn. 38138

[21] Appl. No.: 08/374,039

[22] Filed: Jan. 18, 1995

[51] Int. Cl.[6] ..... B42D 15/00

[52] U.S. Cl. ..... 283/67; 229/92.8; 281/29; 283/116

[58] Field of Search ..... 229/92.8; 283/116, 283/117, 67; 281/51, 29

[56] References Cited

U.S. PATENT DOCUMENTS

| | | | |
|---|---|---|---|
| 314,215 | 3/1885 | Reynolds . | |
| 867,613 | 10/1907 | Scragg | 281/29 |
| 1,169,738 | 1/1916 | Smiley . | |
| 1,250,706 | 12/1917 | Suyehiro . | |
| 4,817,989 | 4/1989 | Pendergast | 229/92.8 X |

*Primary Examiner*—Andrea L. Pitts
*Assistant Examiner*—Monica Smith
*Attorney, Agent, or Firm*—Hoffman & Baron, LLP

[57] ABSTRACT

A method and apparatus for providing reassurance that a notification of an occupant's change of address has been received is provided. The apparatus consists of a first document which includes occupant's change of address information, and which is sent to an intended recipient. A second document is also included, to be returned to the occupant, which contains an acknowledgement by the intended recipient that the change of address was received. The first and second documents may be detachably connected, and integrally supplied for dispatch to the intended recipient. The invention is particularly useful for children when the intended recipient is an ethereal being such as Santa Claus.

15 Claims, 5 Drawing Sheets

METHOD AND APPARATUS FOR PROVIDING ACKNOWLEDGEMENT OF A RESIDENTIAL RELOCATION

FIELD OF THE INVENTION

The present invention relates to a method for effecting notification of a relocation and acknowledgment of receipt of such notification. More specifically, the present invention relates to a method and kit for notifying an intended recipient of a recent change of address, and for reassuring the person who has recently relocated that the intended recipient receives the notification of change of address.

BACKGROUND OF THE INVENTION

In modern society, residential relocation has become a common practice. Individuals as well as families are commonly relocating to new areas, often moving a great distance from their prior residence. Such moving can cause a great deal of stress, particularly regarding issues such as notification of the move to family friends, relatives, doctors, business acquaintances, etc.

While it is understood that relocation can be difficult for adults, a residential move can be even more traumatic for a child. While adults are concerned with issues such as notifying others of a recent relocation, it can be appreciated that notifying others of a new address is one of the most important concerns of a child. Typically, in order to notify others of a move, a person will mail out a change of address notification. However, such a notification does not provide for any assurance that the notification was actually received and acknowledged. It can be appreciated that children would want assurances that certain people who are important to them, such as their best friend or teacher, will know their new address. Perhaps even more importantly, a child may want to know that certain fictitious and ethereal beings such as Santa Claus and the Easter Bunny know that they have moved.

The present invention provides a solution for such concerns by providing a method and product for notification of a change of address, and for acknowledgment of receipt of such notification.

SUMMARY OF THE INVENTION

The present invention relates to a method and apparatus for providing reassurance that a notification of an occupant's change of address has been received.

In its method aspect, the present invention relates to a method of providing acknowledgement from a recipient of an occupant's change of address, which includes providing to the occupant a first document which includes identification of an intended recipient and a document portion capable of accommodating change of address indicia; arranging for dispatch of the first document from the occupant; providing a second document which includes information acknowledging the change of address by the intended recipient and further includes a second document portion capable of accommodating change of address indicia obtained from the first document; and arranging for delivery of the second document to the occupant.

The method of the present invention may further include arranging for delivery of the first document to the intended recipient, and arranging for delivery of the second document from the intended recipient to the occupant. The first and second documents may be integrally supplied and detachably connected.

The present invention contemplates the intended recipient as an ethereal being, in which case delivery of the first document, or the first and second documents integrally supplied, is arranged to a delivery processing service. In such a case, the second document is processed by the delivery processing service, and delivery of the second document is made by the delivery processing service so as to appear as being made from the ethereal being.

The first and second documents may contain demonstrative indicia thereon, such as graphic or pictorial representations of the ethereal being to which the change of address notification is intended to be sent.

The present invention also relates to a kit of parts used to reassure an occupant that a change of address has been received by a recipient. The kit includes a change of address document adapted to be provided to the occupant and which has an indicia-bearing portion adapted to accommodate change of address information. The change of address document further includes recipient identification indicia and recipient delivery indicia for effecting delivery of the change of address document to the recipient. An acknowledgement document is also included which is adapted to be provided to the recipient. The acknowledgement document has an indicia-bearing portion and is adapted to accommodate the occupant's change of address information. The acknowledgement document includes acknowledgement indicia indicating receipt by the recipient of the change of address, and further includes occupant delivery indicia for effecting delivery of the acknowledgement document to the occupant.

The change of address document and acknowledgement document may be incorporated as a document assembly. The acknowledgement document may be adapted for removal from the assembly by the recipient for return delivery to the occupant. The document assembly may include the change of address document and the acknowledgement document detachably connected.

The present invention also relates to a method for reassuring a child that a change of residential address has been received by an ethereal being which includes providing a change of address document having a portion thereof on which child supplied change of address information is placed, and further includes indicia thereon indicating that delivery of the change of address document is to be made to the ethereal being. The change of address document is delivered to a receiving location. An acknowledgement document is provided at the receiving location which includes indicia thereon identifying the ethereal being and which has a portion on which the change of address information is placed. The acknowledgement document further includes indicia which indicates that the document originated from the ethereal being. The acknowledgement document is delivered to the child.

The change of address information may be processed at the receiving location, preferably by generating the acknowledgement document with the change of address information thereon at the receiving location, and further by placing the change of address information on the provided acknowledgement document.

Figure 1:
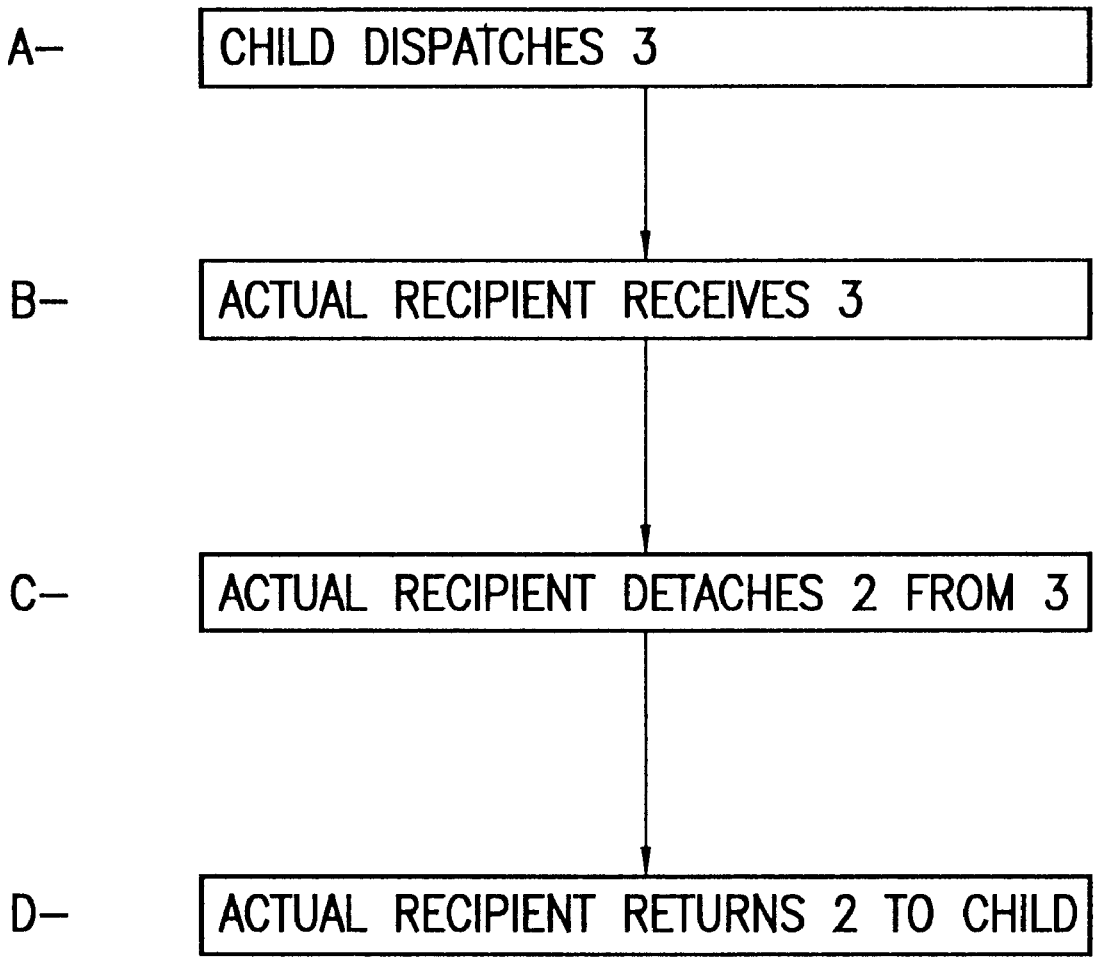
FIG. 1 is a flow chart representing a preferred embodiment of the invention.

DETAILED DESCRIPTION OF THE INVENTION:

The present invention provides a method and apparatus for providing reassurances that a notification of an occupant's change of address has been received by an intended recipient. The present invention is particularly well suited for children experiencing a residential relocation.

In a preferred embodiment of the invention, a child is provided with a package that contains numerous documents regarding a change in address. The documents contain a section to be completed by or on behalf of the child which will notify another of a change in address. The documents can be prepared with general identification intended to be sent to certain individuals who are known by the child. For example, the documents can be pre-printed with general headings such as teacher, Godparent, best friend, etc., thereby assisting the child in identifying typical individuals who would need to be notified of such an address change.

The package may further contain a log sheet for identifying the individuals to whom the child has sent notifications of a change in address. Such a log sheet could assist the child in identifying which individuals have been notified of the child's new address, and could also assist in identifying which individuals have not yet responded to the child's notification of address change.

The notification intended to be sent to a specific individual preferably consists of two documents. The first document preferably consists of a notice to be mailed to the specific individual, with a section for completing the child's new address. The second document preferably consists of a notice to be mailed to the child, in the form of an acknowledgement document assuring the child that the individual received the notice of change in address. In one embodiment of the invention, the first and second documents are detachably connected as a document assembly, such that the child can complete the change of address information on the first document and mail the detachably connected first and second documents as a document assembly to the individual recipient. Once the recipient receives the first and second documents detachably connected, since the documents are adapted for removal, the recipient can detach the second document from the document assembly and return it to the child, typically by mailing it. This return mailing to the child permits notification to the child that the first document noting the child's new address was safely received and acknowledged by the recipient.

The present invention contemplates delivery and dispatch of the documents in a variety of mediums, including, but not limited to, the U.S. Postal Service, private delivery services, electronic delivery services, facsimile transmittal devices and the like. Combinations of various methods of delivery and dispatch are also contemplated by the present invention.

In another embodiment of the present invention, the intended recipient of the notice of change in address is an ethereal being. Examples of ethereal beings which are contemplated by the present invention include Santa Claus, the Easter Bunny, the Tooth Fairy, an imaginary friend, a guardian angel, and other fictitious beings. In such an embodiment, the first document including the notice of change in address cannot actually be sent to the ethereal being. In these instances, the first document is arranged for delivery to a delivery processing service or a receiving location.

This arrangement can be accomplished by pre-printing the first document containing the child's change of address information such that it is addressed to the delivery processing service. After the child completes the information on the first document relating to the change in address, the child dispatches the first document to the ethereal being. Since the first document is pre-printed with the delivery processing service's address, it will be delivered directly to such service. The first document may contain demonstrative indicia thereon such as a graphic or pictorial representation which the child would associate with the ethereal being. The first document may also contain demonstrative indicia which the child would associate with the ethereal being's apparent address.

The service, after receiving the first document from the child, processes the information and completes a second document. The second document contains a notification that the change of address has been received by the ethereal being. The second document is made to appear as being sent by the ethereal being. This can be accomplished by providing information on the second document which the child will understand as relating to the ethereal being. For instance, the second document may contain a demonstrative indicia such as a graphic or pictorial representation of the ethereal being which the child would associate with the ethereal being as well as a written indicia such as a personalized message to the child apparently from the ethereal being.

After completing the second document, the delivery processing service arranges for the second document to be delivered to the child. This delivery is preferably accomplished by mailing the second document through the United States Postal Service. Once the child has received the second document, the child will be assured that the ethereal being is aware of the child's new address.

Figure 3:
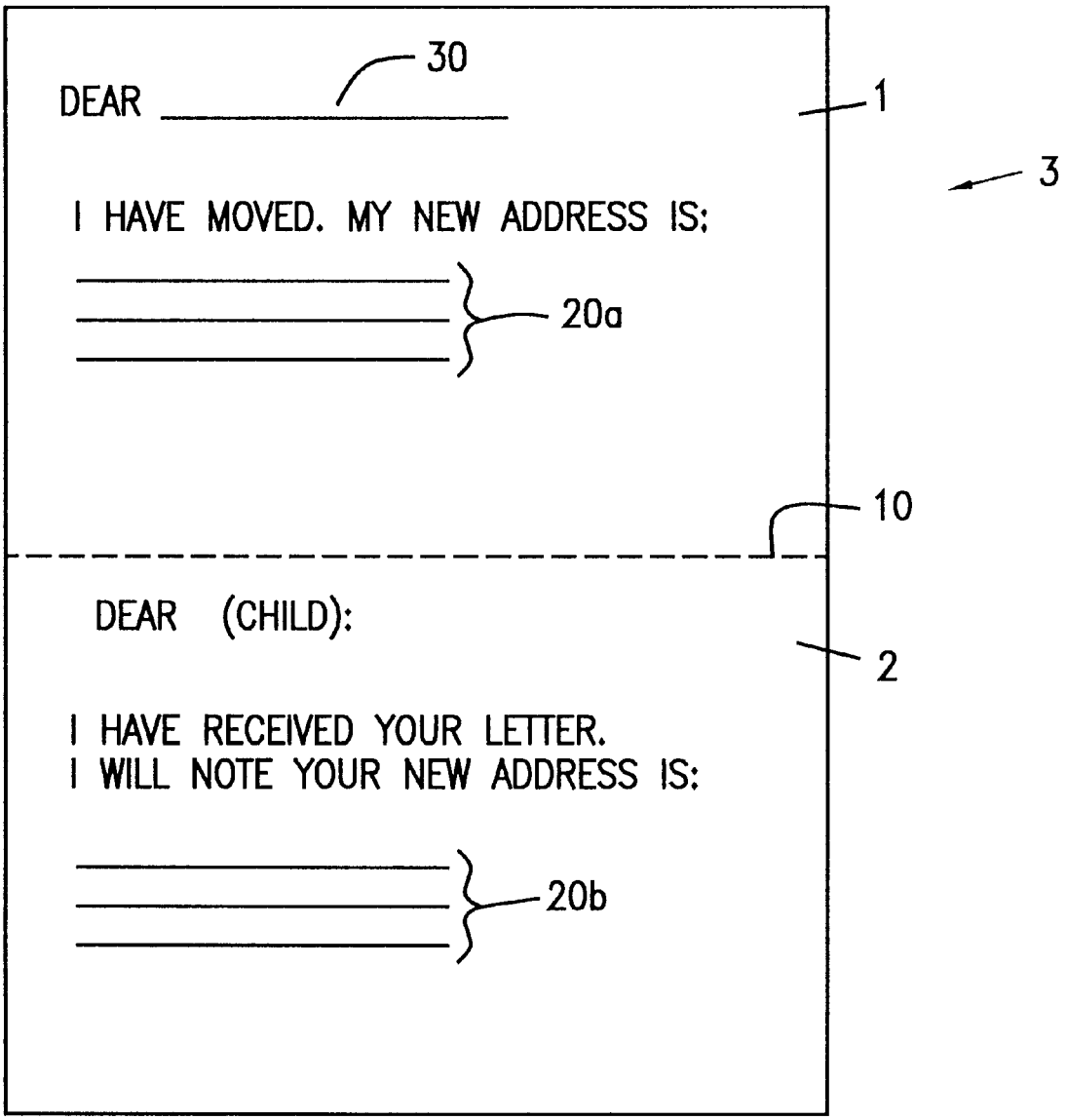
FIG. 3 is a depiction of a letter of the preferred embodiment of the invention.

Referring to the drawings, FIG. 3 depicts one embodiment of the present invention. In such an embodiment, the document assembly exists as notification letter 3 which consists of first document I and second document 2. In this preferred embodiment, first document 1 and second document 2 are detachably connected at perforation 10. Perforation 10 permits first document 1 and second document 2 to be connected for dispatch, yet enables them to be separated by the recipient once received.

First document 1 includes recipient identification 30. Identification 30 functions as a header for first document 1, identifying the recipient for which letter 3 is intended to be sent. Identification 30 may be pre-printed on first document 1 prior to providing first document 1 to said child. For instance, first document 1 may be pre-printed with identification 30 completed to identify "teacher" as the recipient. Such pre-printing of identification 30 assists the child in identifying important individuals to whom the child may want to sent a change of address notification (graphic or pictorial details may also be included). Identification 30 may also be left as a blank space, in which instance the child can fill in a specific person to whom the child wishes a notification be sent.

First document 1 also includes new address notification 20*a* . New address notification 20*a* may be pre-printed with the child's new address, or may be left blank for the child to complete. New address notification 20*a* functions to notify the recipient of letter 3 that the child has moved to the new address identified in new address notification 20*a*.

After the recipient identified in identification 30 receives letter 3, the recipient becomes aware of the child's new address through new address notification 20*a* . The recipient can then detach second document 2 from letter 3 by way of perforation 10. Second document 2 consists of a letter which is intended to notify the child that the change of address notification has been received by the recipient identified in identification 30 of first document 1. Second document 2 includes new address acknowledgment 20*b*. New address acknowledgment 20*b* may be pre-printed with the child's new address, or may be completed by the child before letter 3 is sent to the recipient. Alternatively, new address acknowledgment 20*b* may be left blank to be later completed by the recipient, thus further assuring the child that the recipient of identification 30 acknowledges the new address of the child.

After detaching second document 2 and completing new address acknowledgment 20*b* if necessary, the recipient can return second document 2 to the child by return mail, thereby assuring the child that the new address notification has been received.

Referring to FIG. 1, a flow chart is shown which represents the preferred embodiment of the invention in application when the intended recipient is an actual person. In step A, the child dispatches letter 3 to the recipient, identified by identification 30. This dispatch is typically accomplished by mailing letter 30 with the U.S. Postal Service. In step B, the recipient identified in identification 30 receives letter 3. The recipient then detaches second document 2 from letter 3. After detaching second document 2, the recipient returns second document 2 to the child, typically by mailing second document 2 with the U.S. Postal Service. When the child receives second document 2 from the recipient, the child is assured that the recipient is made of aware of the child's new address.

Figure 4:
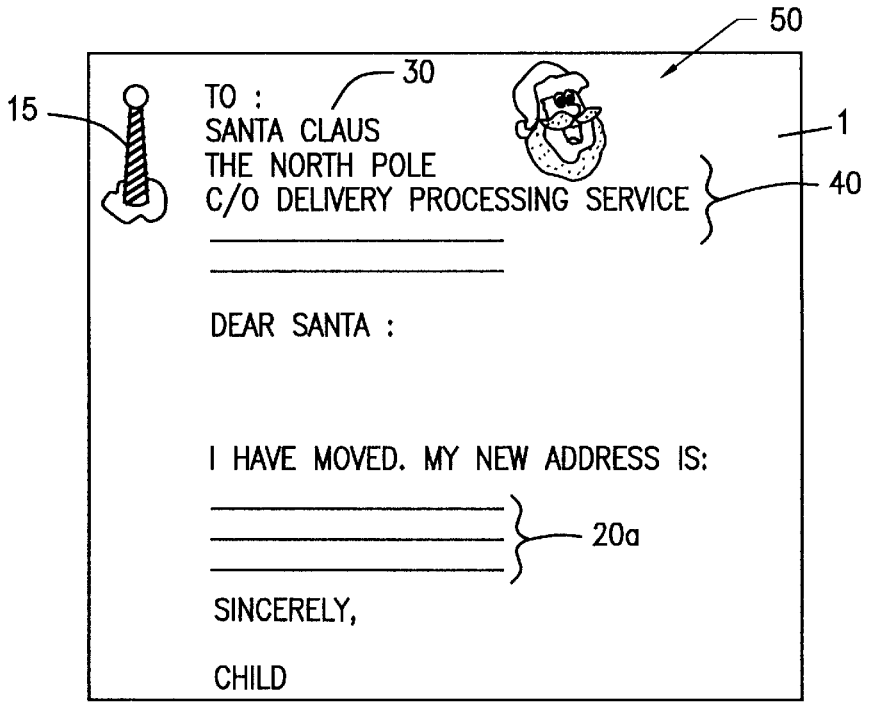
FIG. 4 is a depiction of a first document of an alternative embodiment of the invention.
Figure 5:
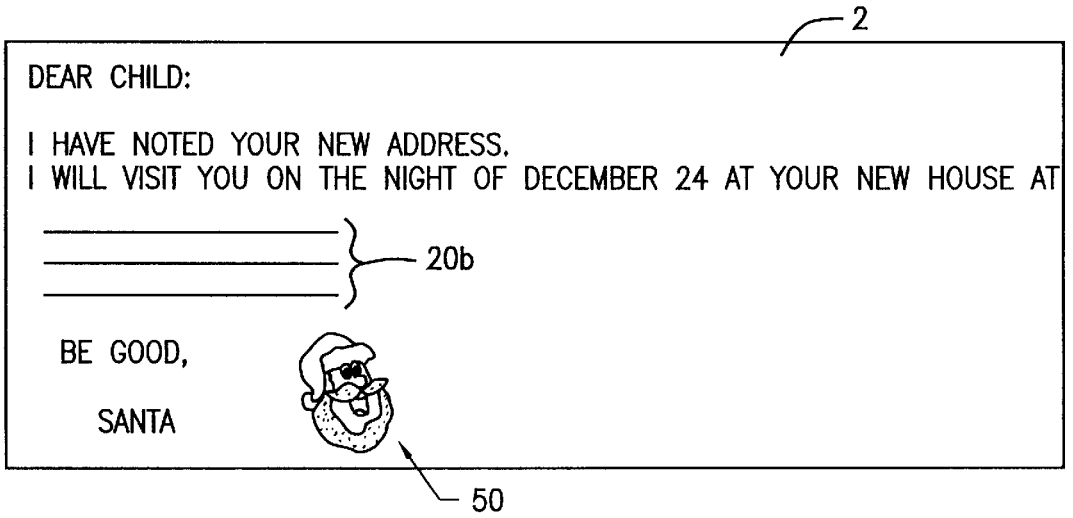
FIG. 5 is a depiction of a second document of an alternative embodiment of the invention.

Referring to FIGS. 4 and 5, an alternative embodiment of the present invention is shown. In this embodiment, the intended recipient of the change of address notification is an ethereal being. FIG. 4 shows first document 1, addressed to an ethereal being, in this example Santa Claus. First document 1 includes delivery processing address 40. Delivery processing address 40 is typically pre-printed with a specific address identifying a delivery processing service. In this embodiment, first document 1 cannot actually be delivered to the intended recipient, as the intended recipient is an ethereal being. By providing delivery processing address 40 on first document 1, first document 1 will be delivered to the delivery processing service identified by delivery processing address 40. Thus, while the child believes the first document is being mailed to the ethereal being, it will actually be delivered to the delivery processing service.

First document 1 also contains new address notification 20*a*, which, as in the preferred embodiment, may be pre-printed with the child's new address or may be left blank for the child to complete the change of address information. Thus, when first document 1 is dispatched by the child, typically by mailing with the U.S. Postal Service, the child will believe that the ethereal being will be notified of the child's new address as listed in new address notification 20*a*.

First document 1 may also contain identifying indicia 50 which the child associates with the particular ethereal being to whom the change of address is being sent. For instance, indicia 50 may be in the form of a graphic or pictorial representation of the ethereal being, as in FIG. 4, which shows a pictorial representation of Santa Claus at indicia 50. Such indicia 50 further assures the child that the change of address notification is being sent to and received by the ethereal being identified by indicia 50.

First document 1 may further include address indicia 55, which the child associates as the address of the particular ethereal being to whom the change of address is being sent. For instance, address indicia 55 may be in the form of a graphic or pictorial representation of the ethereal being's supposed address, as in FIG. 4, which shows a pictorial representation of the North Pole at address indicia 55. Such address indicia 55 provides further assurance to the child that the change of address notification is being sent to and received by the address of the ethereal being identified by address indicia 55.

FIG. 5 depicts second document 2 in this alternative embodiment of the invention. Second document 2 consists of a letter or certificate intended to be sent to child and is meant to appear as if it is being sent by the ethereal being to which first document 1 has been sent. This can be accomplished by providing indicia 50 on second document 2, which the child associates with the specific ethereal being to which first document 1 has been sent.

Second document 2 includes new address acknowledgment 20*b*, as in the preferred embodiment. New address acknowledgment 20*b* may be pre-printed with the child's new address. Alternatively, new address acknowledgment 20*b* may be completed by the delivery processing service, thus assuring the child that the ethereal being has received first document 1 and has been made aware of the new address of the child. Second document 2 may be formed as a certificate to serve as a keepsake for the child.

Figure 2:
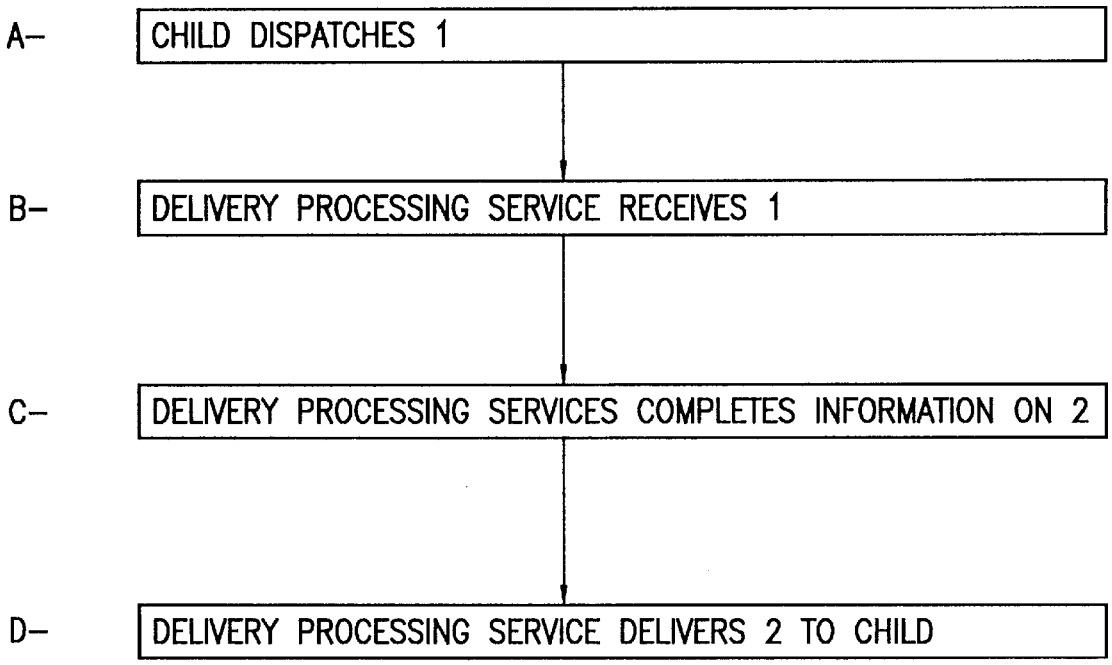
FIG. 2 is a flow chart representing an alternative embodiment of the invention.

Referring to FIG. 2, a flow chart is shown which represents the alternative embodiment of the invention in application when the intended recipient is an ethereal being. In step A, the child dispatches first document 1 to the ethereal being identified by indicia 50. This dispatch is typically accomplished by mailing letter 30 with the U.S. Postal Service. However, since first document 1 contains delivery processing address 40, first document 1 is actually delivered to the delivery processing service. In step B, the delivery processing service to which first document 1 has been addressed by delivery processing address 40 receives first document 1. The delivery processing service then completes the new address acknowledgment 20*b* as in step C, typically by including the child's new address if it has not already been printed on second document 2.

In step D, the delivery processing service then arranges for delivery of second document 2 to the child, typically by mailing second document 2 with the U.S. Postal Service. When the child receives second document 2 from the delivery processing service, the child believes that second document 2 is being sent by the ethereal being to which the child believes first document 1 has been sent, and the child is assured that the ethereal being is made of aware of the child's new address.

Figure 6:
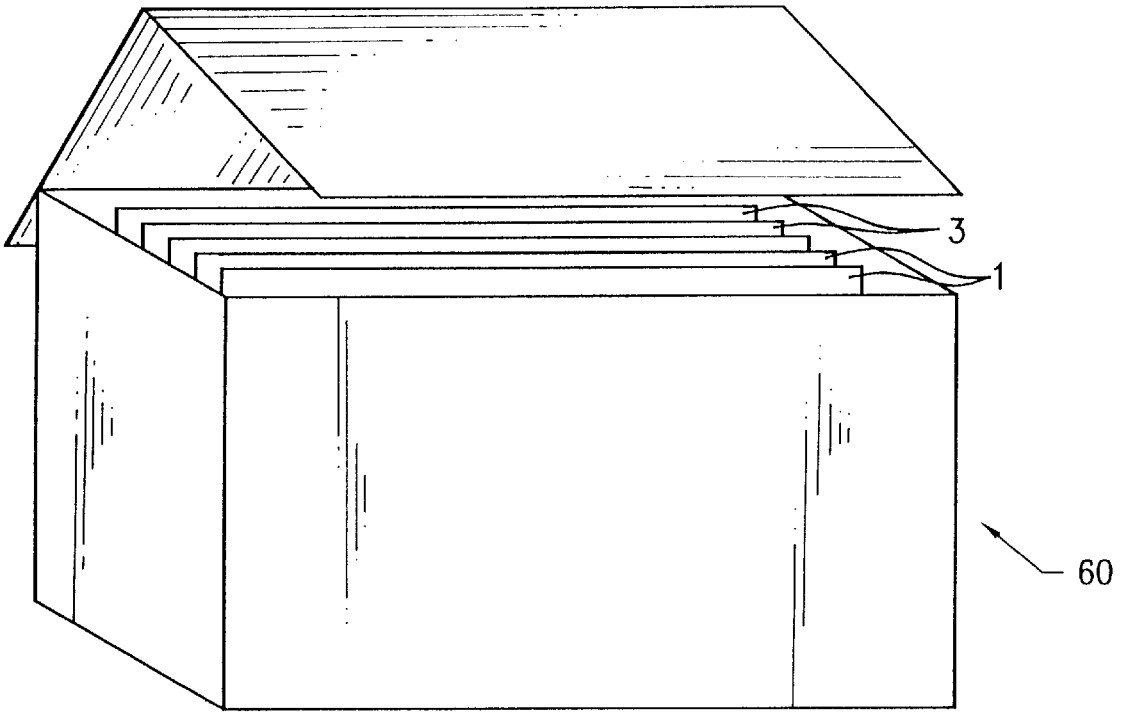
FIG. 6 is a diagram of a kit of the present invention.

Referring to FIG. 6, a kit is shown generally as kit 60. Kit 60 consists of a container such as a box which contains a plurality of first documents 1, and may also contain a plurality of letters 3. First documents 1 and letters 3 contained within kit 60 may be pre-printed with information such as the child's new address notification 20*a*, new address acknowledgment 20*b*, identification 30, indicia 50 and address indicia 55. Alternatively, first documents 1 and letters 3 supplied with kit 60 may be left blank for completion by the child.

Kit 60 is preferably provided to the child by a service associated with a residential relocation, such as a real estate agent or service, a real estate attorney or a mortgage company.

Other channels of distribution are contemplated by the present invention, such as retail establishments frequented by children, restaurants and food chains, and toy stores. It is also contemplated that a separate organization may be set up to sell or distribute kit 60 as well as provide the processing service described above. In the instances when first documents 1 are included in the kit to be sent to ethereal beings, it is preferred that the same service which provides kit 60 to the child will also provide second documents 2 to the delivery processing service to which the first documents are to be sent.

While the invention has been described herein in terms of certain preferred embodiments, those skilled in the art will recognize that various modifications can be made without departing from the scope of the present invention.

What is claimed is:

1. A method of providing acknowledgment from a recipient of an occupant's change of address, comprising the steps of:

a) providing a first document to said occupant, said first document including identification of an intended recipient who is an ethereal being and a document portion capable of accommodating change of address indicia;

b) arranging for apparent delivery of said first document from said occupant to said intended recipient by arranging for dispatch of said first document to a delivery processing service;

c) providing a second document, said second document including information acknowledging said change of address by said intended recipient and including a second document portion capable of accommodating change of address indicia obtained from said first document; and d) arranging for delivery of said second document from said delivery processing service to said occupant.

2. A method of claim 1 wherein said step a) further includes providing said first document with said document portion capable of accommodating occupant-supplied change of address indicia.

3. A method of claim 1 wherein said step b) further includes:

arranging for delivery of said first document to said intended recipient.

4. A method of claim 3 wherein said step d) further includes:

arranging for delivery of said second document from said intended recipient to said occupant.

5. A method of claim 4 wherein said first and said second documents are integrally supplied and wherein said step b) includes:

arranging for delivery of said first and said second documents to said intended recipient.

6. A method of claim 5 wherein said first and said second documents are detachably connected and wherein step d) includes arranging delivery of said second document detached from said first document.

7. A method of claim 1 wherein step a) further includes:

providing said first document with graphic/pictorial representations of said ethereal being.

8. A method of claim 1 wherein step c) further includes:

providing said second document with graphic/pictorial representations of said ethereal being.

9. A method of claim 1 wherein said first and second documents are integrally supplied and wherein said step b) includes:

arranging for delivery of said first and said second documents to said delivery processing service.

10. A method of claim 9 wherein said first and said second documents are detachably connected and wherein step d) includes arranging for delivery by said delivery processing service of said second document detached from said first document.

11. A method of reassuring a child that a change of residential address has been received by an ethereal being comprising the steps of:

providing a change of address document having indicia thereon identifying said ethereal being, said change of address document having a portion thereof on which change of address information is placed, said change of address document further including indicia thereon indicating delivery of said change of address document is to be made to said ethereal being;

delivering said change of address document to a receiving location;

providing an acknowledgement document at said receiving location, said acknowledgement document including indicia thereon identifying said ethereal being, said acknowledgement document having a portion on which said change of address information is placed, said acknowledgement document further including indicia indicating that said acknowledgement document originated from said ethereal being; and delivering said acknowledgement document to said child.

12. A method of claim 11 wherein said change of address information is child-supplied.

13. A method of claim 12 further including the step of:

processing said child-supplied change of address information at said receiving location.

14. A method of claim 13, wherein said processing step includes generating said acknowledgement document with said child-supplied change of address information thereon at said receiving location.

15. A method of claim 11, wherein said generating step further includes:

placing said change of address information on said provided acknowledgement document.

* * * * *